United States Patent [19]

Walter et al.

[11] Patent Number: 5,031,325

[45] Date of Patent: Jul. 16, 1991

[54] HAND-HELD TOOL WITH A CUTTING OR GRINDING DISK

[75] Inventors: Manfred Walter; Wolfgang Erdt, both of Munich, Fed. Rep. of Germany

[73] Assignee: Hilti Aktiengesellschaft

[21] Appl. No.: 547,621

[22] Filed: Jul. 2, 1990

[30] Foreign Application Priority Data

Jul. 1, 1989 [DE] Fed. Rep. of Germany ..... 3921772

[51] Int. Cl.[5] ..... B25F 5/02; B24B 27/08; B28D 7/02; B28D 1/22

[52] U.S. Cl. ..... 30/390; 51/268; 125/13.01

[58] Field of Search ..... 30/122, 124, 390, 391, 30/389, 500; 51/268, 273; 125/13.01

[56] References Cited

U.S. PATENT DOCUMENTS 3,382,578 5/1968 Dobbertin ..... 51/268
3,818,648 6/1974 Evans ..... 51/268
3,969,856 7/1976 Zerrer ..... 51/268

FOREIGN PATENT DOCUMENTS 608790 11/1960 Canada ..... 30/391
3636300 4/1988 Fed. Rep. of Germany ..... 51/268

*Primary Examiner*—Douglas D. Watts
*Attorney, Agent, or Firm*—Toren, McGeady & Associates

[57] ABSTRACT

A hand-held tool for driving a cutting or grinding disk includes a housing and a protection hood with a sleeve-shaped extension detachable connected to the housing. A receptacle is mounted on the housing for releaseably holding the sleeve-shaped extension. The receptacle is formed as a slotted sleeve so that it has a variable diameter. The diameter is changed by moving circumferential ends of the sleeve toward or away from one another. The displacement of the sleeve ends can be effected by a lever pivotly mounted on the ends.

7 Claims, 1 Drawing Sheet

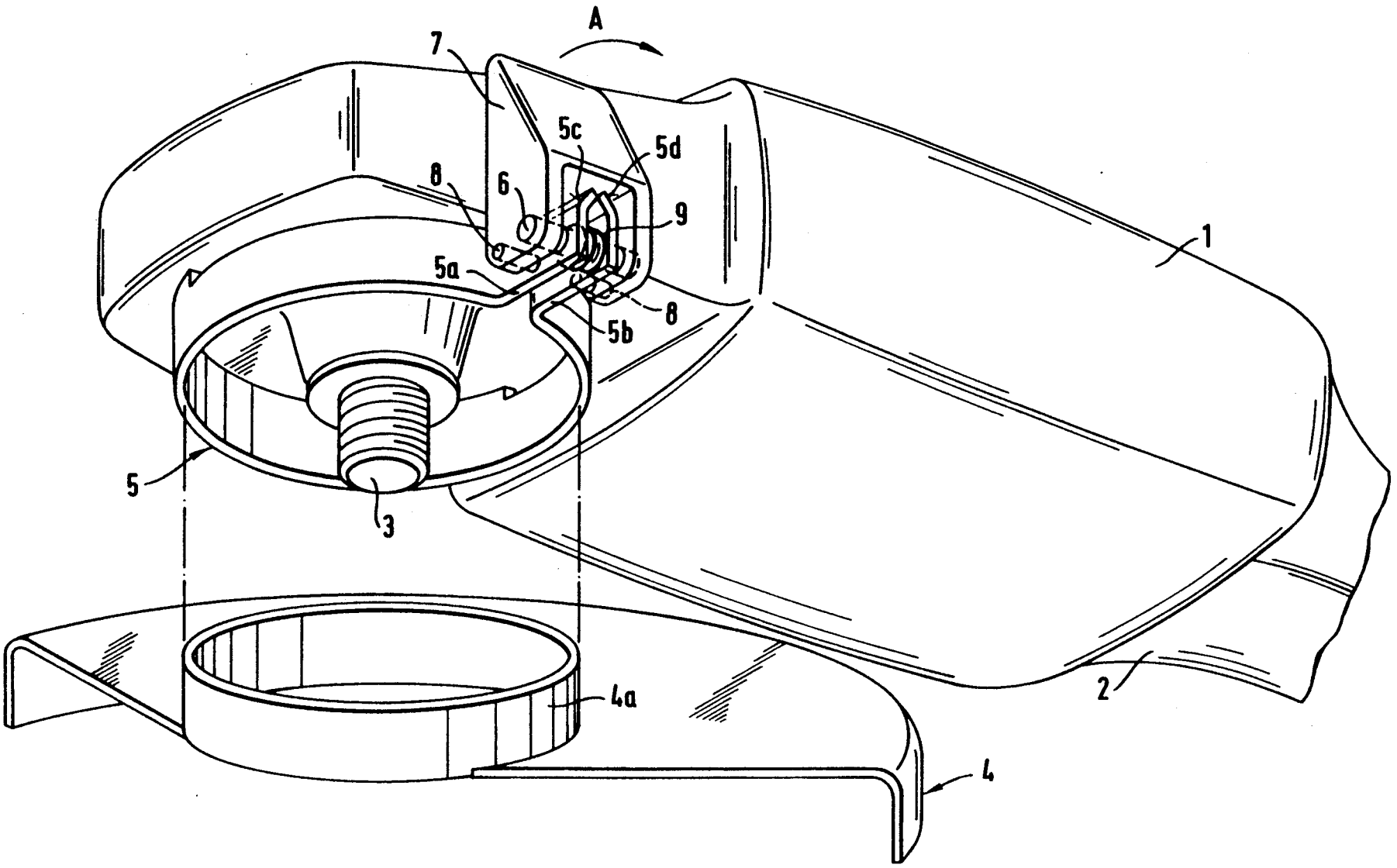
1
2
4
4a
A
5d
9
8
5b
5c
6
7
8
5a
3
5

HAND-HELD TOOL WITH A CUTTING OR GRINDING DISK

BACKGROUND OF THE INVENTION

The present invention is directed to a hand-held tool for driving a cutting or grinding disk. The tool includes a housing and a protective hood partially surrounding the disk and detachably connected to the housing. The protective hood has a sleeve-shaped extension arranged to be detachably connected to the housing.

Hand-held tools of the above mentioned typed are equipped with a protective hood partially surrounding the disk so that the danger of injury is reduced and uncontrolled outward displacement of the piece being worked on is prevented. Depending on the position in which the hand-held tool is used, different positions of the disk have to be exposed by the protective hood.

Because different positions of the disk have to be exposed, it has been known to connect protective hoods on the housing in a detachable manner. In the detached state, the protective hood can be turned with respect to the housing. For secure clamping of the protective hood when it is properly aligned with respect to the housing, it has been known in DE-GM 1 804 220 to provide the protective hood with a sleeve-shaped extension that is adjustable in diameter and cooperates with a corresponding part on the housing. A set screw actuated by a tool serves to change the diameter.

Depending on the position of the protective hood, it is possible that the set screw assumes a position blocked by the housing, so that is inaccessible. Accordingly, the protective hood cannot be adequately clamped.

SUMMARY OF THE INvENTION

Therefore, it is the primary object of the present invention to provide a hand-held tool of the above mentioned type where the protective hood can be securely clamped in any position on the housing without the need of any special tools.

In accordance with the invention, the housing has a receptacle thereon adjustable in diameter for receiving the sleeve-shaped extension of the protective hood.

By arranging the receptacle adjustable in diameter on the housing of the hand-held tool, it is possible to provide an adjustment mechanism on the housing. As a result, the adjustment mechanism is always located in the same position independent of the position of the protective hood. The accessibility of the protective hood is maintained in any position. Preferably, the receptacle is designed as a slotted sleeve so that its circumferential ends can be displaced relative to one another for varying the diameter of the receptacle. In the arrangement of such a slotted sleeve, an accessible tight clamping of the protective hood equipped with a sleeve-shaped extension is assured in any desired rotational position of the hood.

To avoid the use of any special tools in effecting the adjustment, the circumferential ends of the slotted sleeve can be displaced relative to one another by an eccentric control lever. Such eccentric lever can cooperate with bent-lugs on the circumferential ends of the slotted sleeve and these lugs can mount the supports or bearings for the eccentric control lever.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The drawing is a perspective view of a hand-held tool embodying the present invention with the protective hood shown in a position removed from the housing.

DETAILED DESCRIPTION OF THE INVENTION

In the drawing the hand-held tool includes a housing 1 with a handle 2, shown only in part, projecting from the housing. At the opposite end of the housing 1 from the handle 2 a spindle 3 projects from the housing for receiving a grinding disk, not shown. A protective hood 4 arranged to partially surround the disk is shown in a position removed from the housing. The hood 4 has a sleeve-shaped extension **4*a* for detachable connection with the housing 1. In the drawing, a receptacle 5 with a variable diameter encircles the spindle 3 and is aligned with the sleeve-shaped extension 4*a* of the hood 4 so that the extension fits into the receptacle. The receptacle is formed as a slotted sleeve 5, however, it is not continuous in the circumferential direction. The sleeve 5 has circumferential ends 5*a*, 5*b* which can be displaced relative to one another in the circumferential direction for changing the diameter of the receptacle. Each of the ends 5*a*, 5*b* is bent out of the circumferential direction and extends radially outwardly. Sleeve 5 is connected with the housing 1 only over a portion of its circumference, so that its diameter can be varied by relative displacement of the ends 5*a*, 5*b*. The inside diameter of the sleeve 5 can be matched to the outside diameter of the extension 4*a* of the protective hood 4 for securing the hood on the housing 1. Radially outwardly from the circumference of the sleeve 5, the bent-off ends 5*a*, 5*b* are penetrated by bolt 6. A lever 7 is pivotally supported on the bolts 6. In addition, lever 7 has two pins 8 each bearing against the ends 5*a*, 5*b* radially inwardly from the bolt 6. If lever 7 is pivoted through an angle of 90° in the direction of the arrow A, the pins are displaced upwardly as viewed in the drawing and reach the region of the run-up bevels 5*c*, 5*d* along the upper radially extending edges of the ends 5*a*, 5*b*. As a result, the sleeve 5 opens due to its elasticity or due to the effect of a spring element 9 arranged between bent-off ends 5*a*, 5*b*. The ends 5*a*, 5*b* are located in the portion of the circumference of the sleeve 5 not connected with the housing. Due to the opening of the sleeve or the increase in its diameter, the clamping of the extension 4*a* is released, and the hood can be rotated into any desired position about the spindle 3. Subsequently, the hood can be clamped in position by pivoting the lever 7 back into the position as shown in the drawing. In this reverse movement of the lever 7, pins 8 are displaced from the run-up bevels 5*c*, 5*d* to the parallel portions of the ends 5*a*, 5*b* causing the ends to moved closer together into the clamping position. Accordingly, the protective hood 4 is tightly clamped with the housing 1. In place of the lever 7 and the run-up bevels 5*c*, 5*d*, the displacement of the ends 5*a*, 5*b*** of the sleeve can be effected by an eccentric control lever.

While specific embodiments of the invention have been shown and described in detail to illustrate the application of the invention principles, it will be understood that the invention may be embodied otherwise without departing from such principles.

We claim

1. A hand-held tool for driving a cutting or grinding disk comprises a housing (1), and a protective hood (4) detachable connected to said housing and arranged to partially surround the disk, said protective hood (4) comprises a sleeve-shaped extension (4*a*) projecting from said hood and detachable connectable with said housing (1), wherein the improvement comprises that said housing (1) includes a receptacle (5) for receiving and holding said sleeve-shaped extension (4*a*), and said receptacle has a variable diameter for releasing and securing said extension.

2. A hand-held tool, as set forth in claim 1, wherein said receptacle is a slotted sleeve (5) having circumferential ends (5*a*, 5*b*) displaceable relative to one another for varying the diameter.

3. A hand-held tool, as set forth in claim 2, wherein a lever is connected to said circumferential ends (5*a*, 5*b*) of the slotted sleeve (5) for effecting displacement of said sleeve (4) for releasing and securing said extension.

4. A hand-held tool, as set forth in claim 2, wherein said sleeve has a circumferentially extending part with an end (5*a*, 5*b*) on each opposite end of said part, said ends projecting radially outwardly from said part, said radially extending ends (5*a*, 5*b*) being displaceable toward one another for securing said extension (4*a*) and being displaceable away from one another for releasing said extension so that said protective hood (4) can be repositioned.

5. A hand-held tool, as set forth in claim 4, wherein said circumferential extending part of said sleeve (5) is secured to said housing (1) over an angularly extending part thereof with the remaining part being separate from said housing and containing said ends (5*a*, 5*b*).

6. A hand-held tool, as set forth in claim 5, including a lever (7) pivotally connected to said ends (5*a*, 5*b*) and being displaceable between a first position for tightly clamping said extension (4*a*) and a second position for releasing said extension (4*a*).

7. A hand-held tool, as set forth in claim 6, wherein said lever has a first pin pivotally mounting said lever on said ends (5*a*, 5*b*) and a pair of second pins (8) each in bearing contact with a different one of that said ends (5*a*, 5*b*), and said ends having inwardly beveled end portions arranged to be contacted by said second pins (8) when said lever is pivoted from the first position into the second position.

* * * * *